US008292206B2

(12) United States Patent
Michler

(10) Patent No.: US 8,292,206 B2
(45) Date of Patent: Oct. 23, 2012

(54) HYDROGEN-INDUCED DUCTILITY IN ALUMINUM AND MAGNESIUM ALLOYS

(75) Inventor: Thorsten Michler, Hofheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 498 days.

(21) Appl. No.: 12/713,493

(22) Filed: Feb. 26, 2010

(65) Prior Publication Data

US 2011/0209511 A1 Sep. 1, 2011

(51) Int. Cl.
*B21B 9/00* (2006.01)

(52) U.S. Cl. ..... 241/38

(58) Field of Classification Search ..... 72/38, 54, 72/60

See application file for complete search history.

(56) References Cited

U.S. PATENT DOCUMENTS

2011/0252849 A1* 10/2011 Park et al. ..... 72/38

* cited by examiner

*Primary Examiner* — Faye Francis
(74) *Attorney, Agent, or Firm* — Dinsmore & Shohl LLP

(57) ABSTRACT

Ductility of a high-magnesium or high-aluminum content workpiece is increased during plastic deformation of the workpiece. When the workpiece is plastically deformed in a sealed chamber comprising a high concentration of dry hydrogen gas, the workpiece exhibits increased ductility compared to the ductility of a workpiece of identical composition that is similarly deformed in air. Enhanced ductility is quantified for several workpieces comprising aluminum and magnesium alloys in various forms including extruded sheets, drawn bars, rolled plates, and piston casts. Enhanced ductility is evident over a wide range of processing temperatures without a significant decrease in strength characteristics.

23 Claims, 2 Drawing Sheets

HYDROGEN-INDUCED DUCTILITY IN ALUMINUM AND MAGNESIUM ALLOYS

SUMMARY OF THE INVENTION

The present invention relates to a method for increasing ductility in aluminum and magnesium alloys by treatment in hydrogen atmosphere and to a method for forming workpieces comprising the aluminum and magnesium alloys.

BACKGROUND OF THE INVENTION

Ductility is a mechanical property used to describe the extent to which a material can be deformed plastically under stress without fracturing. When a low level of stress is applied, the deformation may be elastic, whereby on removal of the stress the workpiece returns to the shape it had before the stress was applied. At increasing levels of applied stress, the deformation becomes plastic. Beyond a certain level of applied stress, the workpiece fractures. The ductility of the workpiece, therefore, is related to the difference between the stress applied at fracture and the stress applied when deformation first becomes plastic.

Ductility of alloys is an important consideration for the selection of materials to be used in processes requiring forming and working of the alloys. In automobile manufacturing, for example, body panels must be formed into complex shapes with very precise specifications, often by extensive applications of tensile stress on alloy materials. A highly ductile alloy is useful in such an application, because it contributes to the overall workability of the alloy and to the versatility of the forming process. Increasing the ductility of alloys by a modest amount can result in significant cost savings by allowing for a larger range of processing parameters that will not result in undesirable fracturing of workpieces.

Because they exhibit a relatively high strength-to-weight ratio, among a number of other desirable structural features, aluminum and magnesium alloys are of heightened interest in many fields, including automotive engineering. Aluminum and magnesium alloys can be difficult to form into complex geometries, owing to relatively low ductilities and high propagations of defects. For this reason, the alloys often must be processed at elevated temperatures or by using techniques such as die casting or injection molding. One solution might be to seek varying alloy compositions that inherently possess high ductility. However, the efforts spent finding and producing new alloy compositions themselves can be highly cost-prohibitive over attempting to improve the usefulness of existing alloys.

Heat treatments are commonly used in the art to increase the strength and ductility of aluminum and magnesium alloys. Heat treatments may involve processes such as solution annealing, which involves heating alloys to just below the solidus temperature and subsequently quenching the alloys in water or another medium. The heat treatments may involve more elaborate processes comprising very precise temperature ramping schedules that may be combined with physical working of an alloy to increase the elongation of the alloy. Thermal treatments in general can be costly and time consuming.

Hydrogen-induced ductility is a phenomenon known to exist for many titanium-base alloys. Aluminum and magnesium base alloys, however, are generally appreciated in the art of metal forming as being incompatible with hydrogen. Owing in part to several complex physical and electrochemical phenomena, hydrogen can render aluminum and magnesium alloys extremely susceptible to embrittlement and stress corrosion cracking. This is true especially under humid conditions. As such, there remains a need in the art for economical methods to increase the ductility of aluminum and magnesium alloys.

BRIEF SUMMARY OF THE INVENTION

This need is met by the several embodiments of the present invention, whereby ductility of aluminum and magnesium alloys is increased when plastic deformations of the alloys are performed in an atmosphere comprising dry hydrogen gas.

Surprisingly, the present inventor has found that plastically deforming aluminum or magnesium alloys in an atmosphere comprising dry hydrogen gas results in increased ductility of the alloys and no serious embrittlement effects. The increase in ductility has been demonstrated on sheets, bars, and plates comprising common alloys, both at room temperature and at temperatures low as −50° C. This effect may be applied to methods of the present invention for plastically deforming a workpiece comprising an aluminum or magnesium alloy. Such methods offer processing advantages inherent to working with more highly ductile workpieces, including avoidance of the need for the labor- and cost-intensive thermal or physical treatments common in the art.

According to embodiments of the present invention, a method is provided, whereby a workpiece consisting essentially of a metal alloy is worked in an atmosphere comprising dry hydrogen gas. Particularly, the metal alloy is plastically deformed in a controlled hydrogen atmosphere that may comprise inert gases. Under the conditions set forth in the embodiments of the present invention, the workpieces can be deformed in a temporary state of increased ductility.

In accordance with one aspect of the present invention, a method for increasing ductility of a workpiece during plastic deformation includes providing a workpiece, characterized by an initial ductility and comprising an alloy composed of at least 75 weight percent of aluminum or magnesium and less than 0.2 weight percent titanium. The workpiece is placed into a processing chamber. A chamber atmosphere is established, comprising at least 50 vol. % hydrogen gas and a balance of one or more inert gases. A tensile stress may be applied to the workpiece at a level exceeding the yield strength of the alloy, thereby resulting in a plastic deformation. When a desired level of deformation is accomplished, the workpiece may be relieved of the tensile stress and may be removed from the processing chamber. Owing to the chamber conditions, the plastic deformation occurs while the workpiece exhibits a processing ductility that is greater than the initial ductility.

The workpiece may be substantially in the form of an extruded sheet of metal, a drawn bar, a rolled plate, or a cast alloy. The temperature of the chamber may be set within the range of −70° C. to +50° C. The processing chamber may be pressurized to a pressure of 0.1-30 MPa. Ductility of the workpiece may be increased further by performing the plastic deformation in an atmosphere substantially enriched in hydrogen. For example, the chamber atmosphere may be established to comprise at least 90 vol. %, 99 vol. %, or 99.99 vol. % hydrogen gas. Preferably, the chamber atmosphere may comprise at least 99.9999 vol. % hydrogen gas.

In accordance with another aspect of the present invention, a method for increasing the ductility of an extruded sheet of aluminum alloy includes providing an extruded sheet of an alloy comprising at least 75 weight percent aluminum and less than 0.2 weight percent titanium. The composition of the alloy may conform substantially to a standard specification such as Al 2024, Al 4032, Al 6010A, Al 6060, Al 6061, Al 6082, or Al 7075. The temperature of the chamber may be set within the range of −70° C. to +50° C. The processing chamber may be pressurized to a pressure of 0.1-30 MPa. The extruded sheet may be in the form of an automobile component such as a body panel.

In accordance with yet another aspect of the present invention, a method for increasing the ductility of a workpiece during deformation includes providing a workpiece composed of an alloy comprising at least 75 weight percent magnesium. The temperature of the chamber may be set within the range of −70° C. to +50° C. The processing chamber may be pressurized to a pressure of 0.1 MPa to 30 MPa. The composition of the alloy may conform substantially to the standard specification AZ 31.

BRIEF DESCRIPTION OF THE DRAWINGS

The following detailed description of specific embodiments of the present invention can be best understood when read in conjunction with the following drawings.

DETAILED DESCRIPTION

Figure 1:
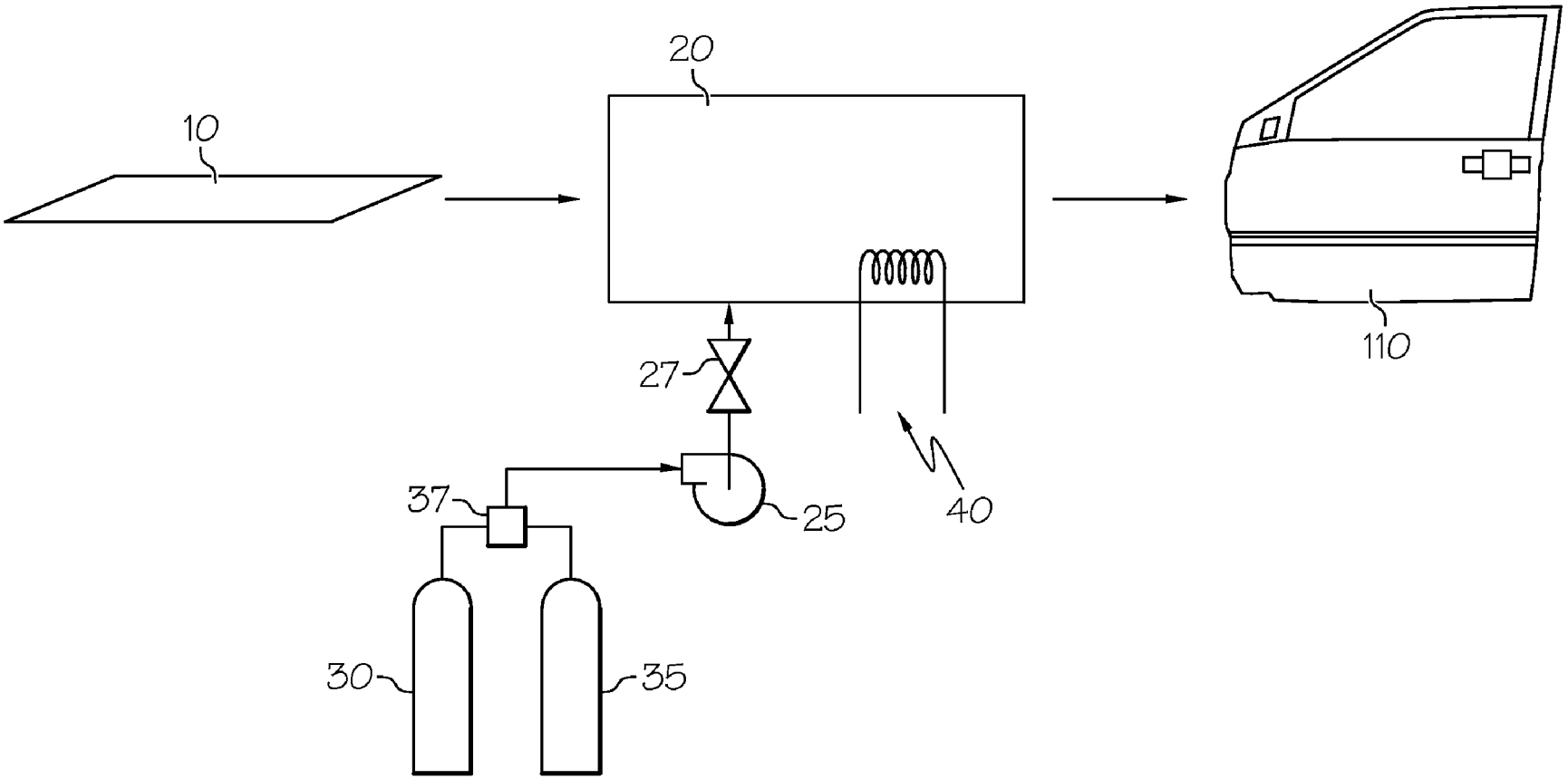
FIG. 1 is a diagram of an exemplary method according to embodiments of the present invention for plastically deforming alloy workpieces under states of increased ductility.

Referring to FIG. 1, in a method for increasing the ductility of a workpiece during plastic deformation, a workpiece 10 may be provided that comprises an alloy composed of less than 0.2 weight percent titanium and at least 75 weight percent of a metal selected from the group consisting of aluminum and magnesium. The alloy defines an initial ductility. The workpiece 10 is placed into a process chamber 20. Process chamber 20 may be a sealed chamber or a chamber otherwise capable of maintaining consistent ratios of process gases without introducing harmful impurities.

A chamber atmosphere is established in the process chamber 20, comprising at least 50 vol. % hydrogen and a balance or one or more inert gases. The hydrogen may be supplied from a hydrogen source 30, and the inert gases may be supplied from a separate source 35. The gases optionally may be mixed in mixing apparatus 37 before being fed into a pump 25 or similar apparatus for injecting gases into the process chamber 20. Appropriate choices for inert gases are characterized by lack of significant reactivity with the hydrogen gas itself, as well as with aluminum or magnesium alloys. Example inert gases include nitrogen, helium, neon, argon, xenon, and krypton. Preferably, the chamber atmosphere may comprise hydrogen fractions considerably higher than 50 vol. %. More preferably, the hydrogen fraction of the atmosphere may be maximized, such that the atmosphere may comprise at least 90 vol. %, 99 vol. %, 99.99 vol. %, or 99.9999 vol. % hydrogen.

Regardless of its hydrogen content, the atmosphere should be substantially free of certain impurities, including water; corrosive gases such as hydrogen sulfide ($H_2S$); oxygen-containing gases such as $CO_2$ and $NO_x$; and carbon-containing gases such as $C_xH_y$. In this context, substantially free may represent the lowest possible, practical amount. In no instance should any of the impurities be present as greater than 100 ppm by volume, preferably 10 ppm by volume, and more preferably 1 ppm by volume of the chamber atmosphere. Oxygen should be limited to compose not greater than 2000 ppm by volume of the chamber atmosphere. To ensure the preferred levels of undesirable impurities, source gases of at least 99.99% purity should be used.

The total pressure of the process chamber 20 should be between atmospheric pressure (about 0.1 MPa) and 30 MPa, with a preferred pressure of about 1 MPa. Increased pressure may be established by means of a pump 25, for example. The pump may be attached to a valve 27 for regulating the pressure. It will be understood by a person of ordinary skill in the art that establishing a desired atmosphere composition may be accomplished by various means that may or may not include one or more successive evacuations and backfills of the process chamber with process gases. Pressurization of the atmosphere similarly may be effected through use of a variety of common apparatus.

The processing chamber may be operated over a wide range of temperatures. A preferred temperature range is between −70° C. and +50° C. Temperature may be controlled by means of control apparatus 40, which may be configured to heat or cool the chamber as desired. A variety of means for controlling temperature are fully contemplated within the scope of the present invention, and depiction of control apparatus 40 should not be construed as limiting. The most preferable temperature may depend in part on the shape and form of the workpiece. For example, extruded sheets may exhibit optimally increased ductility at higher temperatures than may drawn bars or rolled plates.

The workpiece 10 is plastically deformed in the chamber 20 comprising hydrogen. It will be understood by the person skilled in the art that the plastic deformation may occur by applying stress using a variety of means. Preferably, the plastic deformation may by application of a tensile stress in an amount exceeding the yield strength of the workpiece but below the tensile strength of the workpiece. For example, the tensile stress may be applied during a stamping process. During the plastic deformation, the alloy that composes the workpiece defines a processing ductility that is greater than the initial ductility.

The workpiece may be deformed plastically by any desired amount, according to specifications required in a finished product. The workpiece may be deformed in an amount slightly exceeding such specifications to account for any reversal of the deformation to be expected after the tensile stress is removed. When the desired level of plastic deformation is accomplished, the applied stress may be relieved, and the workpiece may be removed from the process chamber. Alternatively, the workpiece may be subjected to further processing within the chamber. An example finished product, specifically a door panel for an automobile, is depicted as 110 in both FIG. 1 and FIG. 2.

In a preferred embodiment, the workpiece 20 is in the form of an extruded sheet composed of an alloy comprising at least 75 wt. % aluminum. Preferably, the alloy may conform substantially to a standard specification such as Al 2024 T4, Al 6010A T6, Al 6060 T6, Al 6061 T6511B, Al 6082 T6, and Al 7075 T651. As to be understood herein, an alloy substantially conforms to a specification when all elements composing the alloy fall into the weight percent ranges set forth in TABLE 1, notwithstanding the presence of residual impurities or minor additives present as less than 0.05 weight percent of the entire alloy.

The preferred standard alloy specifications represent a general, preferred compositional range as follows: up to 1.3 wt. % silicon, up to 1.0 wt. % iron, up to 5.0 wt. % copper, up to 1.0 wt. % manganese, up to 0.40 wt. % chromium, up to 0.25 wt. % zinc, up to 0.15 wt. % titanium, 0.3 to 3.0 wt. % magnesium, and balance aluminum and incidental impurities. Also within the scope of the preferred embodiment, the alloy may conform substantially to standard specification Al 4032 T6, having a nominal compositional range as follows: 11.0 to 13.5 wt. % silicon, up to 1.0 wt. % iron, 0.5 to 1.3 wt. % copper, up to 0.1 wt. % chromium, 0.5 to 1.3 wt. % nickel, up to 0.25 wt. % zinc, 0.8 to 1.3 wt. % magnesium, and balance aluminum and incidental impurities.

Extruded aluminum sheets deformed according to the embodiments of the present invention may be used as components of automobiles. A preferred component is a body panel 50.

According to another preferred embodiment of the invention, a workpiece is provided, being composed of an alloy comprising at least 75 weight percent magnesium. A preferred alloy composition conforms substantially to standard specification AZ 31, with a nominal compositional range 2.5 to 3.5 wt. % aluminum, 0.6 to 1.4 wt. % zinc, 0.2 to 0.5 wt. % manganese, up to 0.1 wt. % silicon, up to 0.05 wt. % copper, up to 0.005 wt. % iron, up to 0.005 wt. % nickel, and balance magnesium and incidental impurities.

The workpiece comprising the magnesium-base alloy may be in the form of an extruded sheet, a drawn bar, a rolled plate, or a cast alloy. Drawn bars are particularly preferred. The workpiece is plastically deformed in a manner according to other embodiments of the present invention. For drawn bars of magnesium, low-temperature deformation is preferred.

Figure 2:
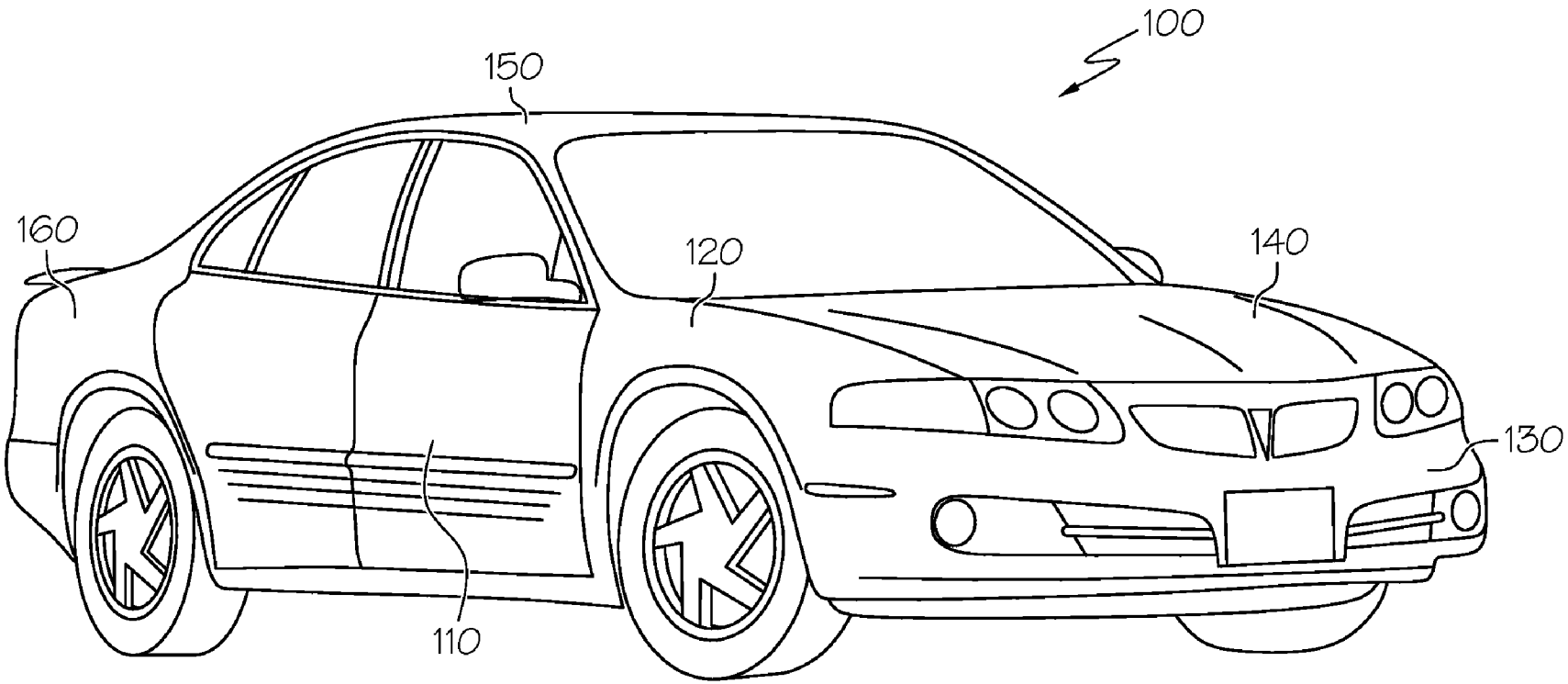
FIG. 2 is a view of an automobile and several components of the automobile that may be formed according to embodied methods of the present invention.

Referring to FIG. 2, some potential uses for aluminum and magnesium alloy-based workpieces deformed according to the embodiments of the present invention are shown. Particularly, in automobile 100 door panel 110, front fender 120, bumper assembly 130, hood 140, roof 150, or rear fender 160 may be formed using methods contained within the embodiments of the present invention. Though body panels represent a preferred embodiment of the present invention, it will be understood that aluminum and magnesium alloys may be used in many automobile applications for which increased ductility during forming is desirable. Example uses include exterior and interior trim, body electricals, instruments and controls, engine accessories, transmission components, clutch components, suspension steering components, bumper system components, brake system components, subframes, fuel storage system components, hydrogen fuel cell components, hydrogen gas storage components, exhaust system components, and wheels.

EXAMPLES

TABLE 1 lists standard specifications for various aluminum and magnesium alloys. TABLE 2 lists nominal compositions of alloys tested as preferred examples of the utility of the present invention. References hereinbelow to specific, tested alloys are made using the sample identifier listed in TABLE 2. Two stainless steels were tested as comparative examples. The tested stainless steels had nominal compositions conforming to the standards shown in TABLE 3.

TABLE 1

Standard specifications of aluminum and magnesium alloys in weight percent, based on the total weight of the alloy. In addition to each of the listed elements, the alloys may contain up to 0.0500 wt. % of particular additional elements. Together, such additional elements may compose up to 0.150 wt. % of the alloy.

| Specification | Type | Si | Fe | Cu | Mn | Cr | Ni | Zn | Ti | Mg | Al |
|---|---|---|---|---|---|---|---|---|---|---|---|
| Al 2014 | AlCu4SiMg | 0.5-1.2 | ≦0.7 | 3.9-5.0 | 0.4-1.2 | ≦0.1 | — | ≦0.25 | ≦0.15 | 0.2-0.8 | bal. |
| Al 2024 | AlCu4Mg1 | ≦0.5 | ≦0.5 | 3.8-4.9 | 0.3-0.9 | ≦0.1 | — | ≦0.25 | ≦0.15 | 1.2-1.8 | bal. |
| Al 4032 | AlSi12.5MgCuNi | 11.0-13.5 | ≦1.0 | 0.5-1.3 | — | ≦0.1 | 0.5-1.3 | ≦0.25 | — | 0.8-1.3 | bal. |
| Al 5083 | AlMg4.5Mn | ≦0.4 | ≦0.4 | ≦0.1 | 0.4-1 | 0.05-0.25 | — | ≦0.25 | ≦0.10 | 4.0-4.9 | bal. |
| Al 5754 | AlMg3 | ≦0.4 | ≦0.4 | ≦0.1 | ≦0.5 | ≦0.3 | — | ≦0.20 | ≦0.15 | 2.6-3.6 | bal. |
| Al 6010A | | 0.8-1.2 | ≦0.5 | 0.15-0.60 | 0.2-0.8 | ≦0.1 | — | ≦0.25 | ≦0.10 | 0.6-1.0 | bal. |
| Al 6060 | AlMgSi0.5 | 0.3-0.6 | 0.1-0.3 | ≦0.1 | ≦0.1 | ≦0.05 | — | ≦0.15 | ≦0.10 | 0.35-0.60 | bal. |
| Al 6061 | AlMg1SiCu | 0.4-0.8 | ≦0.7 | 0.15-0.40 | ≦0.15 | 0.04-0.35 | — | ≦0.25 | ≦0.15 | 0.8-1.2 | bal. |
| Al 6063 | AlMg0.5Si | 0.2-0.6 | ≦0.35 | ≦0.1 | ≦0.1 | ≦0.1 | — | ≦0.10 | ≦0.10 | 0.45-0.90 | bal. |
| Al 6082 | AlMg1SiMn | 0.7-1.3 | ≦0.5 | ≦0.1 | 0.4-1.0 | ≦0.25 | — | ≦0.25 | ≦0.15 | 0.6-1.2 | bal. |
| Al 7075 | AlZn5.5MgCu | ≦0.4 | ≦0.5 | 1.2-2.0 | ≦0.3 | 0.18-0.28 | — | ≦0.20 | ≦0.15 | 2.1-2.9 | bal. |
| AZ 31 | MgAl3Zn | ≦0.1 | ≦0.005 | ≦0.05 | ≧0.2 | — | ≦0.005 | 0.6-1.4 | — | bal. | 2.5-3.5 |
| EN AC-[AlSi8Cu3]KF | | <0.3 | <0.8 | 0.15-0.35 | <0.4 | 0.15-0.6 | <0.05 | 4.5-6.0 | 0.1-0.25 | 0.4-0.7 | bal. |

TABLE 2

Nominal compositions of tested alloys in weight percent, based on the total weight of the alloy. As listed, the corresponding standard specifications include the temper of the test sample.

| Sample | Standard | Form | Si | Fe | Cu | Mn | Cr | Ni | Zn | Ti | Mg | Al |
|---|---|---|---|---|---|---|---|---|---|---|---|---|
| A01 | Al 2014 T6 | extruded | 0.66 | 0.193 | 4.861 | 0.904 | 0.046 | 0.006 | 0.074 | 0.03 | 0.547 | bal. |
| A02 | Al 2024 T4 | extruded | 0.09 | 0.15 | 4.34 | 0.782 | 0.009 | 0.012 | 0.027 | 0.04 | 1.279 | bal. |
| A03 | Al 4032 T6 | extruded | 11.2 | 0.244 | 0.908 | 0.027 | 0.011 | 0.837 | 0.014 | 0.038 | 0.842 | bal. |
| A04 | Al 5754 | drawn bar | 0.08 | 0.255 | 0.008 | 0.234 | 0.006 | 0.001 | 0.014 | 0.01 | 2.76 | bal. |
| A05 | Al 6010A T6 | extruded | 0.9 | 0.169 | 0.569 | 0.419 | 0.107 | — | 0.014 | 0.045 | 0.788 | bal. |
| A06 | Al 6060 T6 | extruded | 0.47 | 0.211 | 0.02 | 0.029 | 0.003 | — | 0.011 | 0.014 | 0.46 | bal. |
| A07 | Al 6061 T6511B | drawn bar | 0.73 | 0.31 | 0.273 | 0.079 | 0.095 | 0.011 | 0.037 | 0.018 | 0.933 | bal. |
| A08 | Al 6063 T6 | extruded | 0.51 | 0.186 | 0.009 | 0.018 | 0.003 | — | 0.011 | 0.011 | 0.528 | bal. |
| A09 | Al 6082 T6 | drawn bar | 0.96 | 0.37 | 0.1 | 0.55 | 0.15 | 0.01 | 0.09 | 0.02 | 0.77 | bal. |
| A10 | Al 6082 T651 | rolled plate* | 1.13 | 0.22 | 0.041 | 0.6 | 0.012 | — | 0.002 | 0.015 | 0.8 | bal. |
| A11 | Al 6082 T6 | extruded | 0.98 | 0.223 | 0.022 | 0.531 | 0.068 | — | 0.101 | 0.023 | 0.632 | bal. |
| A12 | Al 7075 T6 | drawn bar | 0.14 | 0.18 | 1.56 | 0.04 | 0.2 | — | 5.8 | 0.03 | 2.38 | bal. |
| A13 | Al 7075 T651 | rolled plate* | 0.06 | 0.17 | 1.62 | 0.02 | 0.1 | 0.01 | 5.78 | 0.04 | 2.44 | bal. |
| A14 | EN AC-[AlSi8Cu3]KF | piston cast | <0.3 | <0.8 | 0.15-0.35 | <0.4 | 0.15-0.6 | <0.05 | 4.5-6.0 | 0.1-0.25 | 0.4-0.7 | bal. |
| M01 | AZ 31 | drawn bar | 0.01 | 0.002 | <0.01 | 0.22 | — | <0.001 | 0.92 | — | bal. | 2.8 |

*Tested in a transverse direction.

TABLE 3

Nominal compositions of stainless steels tested as comparative examples, in weight percents based on the total weight of the steel.

| Steel | C | Cr | Mn | N | Ni | P | Si | S | Fe |
|---|---|---|---|---|---|---|---|---|---|
| AISI 304 (DIN 1.4301) | ≦0.08 | 18.0-20.0 | ≦2.00 | ≦0.1 | 8.00-10.5 | ≦0.045 | ≦1.00 | ≦0.03 | bal. |
| AISI 316L (DIN 1.4404) | ≦0.03 | 16.0-18.0 | ≦2.00 | ≦0.1 | 10.0-14.0 | ≦0.045 | ≦1.00 | ≦0.03 | bal. |

Mechanical tests were performed on two groups of sample alloys at 20° C. The first group was tested in air at approximately atmospheric pressure (0.1 MPa). The second group was tested in an atmosphere comprising 99.9999 vol. % hydrogen at 10 MPa. The gauge length of each sample was 30 mm. The testing comprised loading a sample into a tensile testing apparatus and establishing the desired atmosphere, pressure, and temperature. Tensile stress was applied to each sample, increasing at a rate of 0.1 mm/min, resulting in a calculated strain rate of $5.5\times10^{-5}$ $s^{-1}$. The materials were tested in the longitudinal direction for all samples except plates A11 and A14, which were tested in the transverse direction. Tensile stress was increased until the samples failed, and strength and ductility parameters were determined. Strength data for the two groups can be found in TABLE 4. Ductility data for the two groups can be found in TABLE 5.

TABLE 4

Strength parameters of samples tested at 20° C. Tests in 99.9999 vol. % $H_2$ were performed at 10 MPa. Tests in air were performed at 0.1 MPa.

| | | Yield Strength (MPa) | | | Ultimate Tensile Strength (MPa) | | |
|---|---|---|---|---|---|---|---|
| Sample | | Air | $H_2$ | % Change $H_2$ vs. Air | Air | $H_2$ | % Change $H_2$ vs. Air |
| A01 | extruded | 462 | 456 | −1.30% | 528 | 517 | −2.10% |
| A02 | extruded | 411 | 402 | −2.20% | 590 | 583 | −1.20% |
| A03 | extruded | 330 | 333 | 0.90% | 371 | 383 | 3.20% |
| A04 | bar | 111 | 109 | −1.80% | 232 | 225 | −3.00% |
| A05 | extruded | 403 | 402 | −0.20% | 421 | 419 | −0.50% |
| A06 | extruded | 196 | 199 | 1.50% | 220 | 242 | 10.0% |
| A07 | bar | 352 | 348 | −1.10% | 373 | 372 | −0.30% |
| A08 | extruded | 211 | 216 | 2.40% | 243 | 243 | 0.00% |
| A09 | bar | 343 | 336 | −2.00% | 359 | 355 | −1.10% |
| A10 | plate | 304 | 302 | −0.70% | 332 | 332 | 0.00% |
| A11 | extruded | 340 | 325 | −4.40% | 357 | 340 | −4.80% |
| A12 | bar | 551 | 548 | −0.50% | 605 | 602 | −0.50% |
| A13 | plate | 543 | 576 | 6.10% | 617 | 610 | −1.10% |
| A14 | cast | 142 | 145 | 2.10% | 172 | 175 | 1.70% |
| M01 | bar | 195 | 194 | −0.50% | 273 | 268 | −1.80% |
| Comparative: AISI 304 (DIN 1.4301) | | 247 | 246 | −0.40% | 600 | 551 | −8.20% |
| Comparative: AISI 316L (DIN 1.4404) | | 250 | 243 | −2.80% | 592 | 572 | −3.40% |

TABLE 5

Ductility parameters of samples tested at 20° C. Tests in 99.9999 vol. % $H_2$ were performed at 10 MPa. Tests in air were performed at 0.1 MPa.

| | | Elongation (%) | | | Reduction in Area (%) | | |
|---|---|---|---|---|---|---|---|
| Sample | Form | Air | $H_2$ | % Change $H_2$ vs. Air | Air | $H_2$ | % Change $H_2$ vs. Air |
| A01 | extruded | 10.5 | 11.2 | 6.7% | 31 | 31.9 | 2.9% |
| A02 | extruded | 14.8 | 16.6 | 12.2% | 19 | 22.2 | 16.8% |
| A03 | extruded | 6.7 | 9.6 | 43.3% | 14 | 17.7 | 26.4% |
| A04 | bar | 27.1 | 27.9 | 3.0% | 62 | 65 | 4.8% |
| A05 | extruded | 11.1 | 12.7 | 14.4% | 39 | 43.5 | 11.5% |
| A06 | extruded | 13.6 | 17.5 | 28.7% | 70 | 76.5 | 9.3% |
| A07 | bar | 11.4 | 13.4 | 17.5% | 44 | 47 | 6.8% |
| A08 | extruded | 12.4 | 14.4 | 16.1% | 39 | 42 | 7.7% |
| A09 | bar | 11.9 | 12.6 | 5.9% | 41 | 40 | −2.4% |
| A10 | plate | 12 | 9.8 | −18.3% | 8 | 20.6 | 158% |
| A11 | extruded | 12 | 15.5 | 29.2% | 49 | 49 | 0.0% |
| A12 | bar | 11.1 | 10.9 | −1.4% | 26 | 29.6 | 13.8% |
| A13 | plate | 7 | 11.8 | 68.6% | 18 | 20.7 | 15.0% |
| A14 | cast | 0.8 | 0.7 | −12.5% | 0.9 | 0.9 | 0.0% |
| M01 | bar | 15.9 | 19.6 | 23.3% | 25.3 | 33.9 | 34.0% |
| Comparative: AISI 304 (DIN 1.4301) | | 74.3 | 37.9 | −49.0% | 86.1 | 36.6 | −57.5% |
| Comparative: AISI 316L (DIN 1.4404) | | 65.7 | 52.4 | −20.2% | 85 | 50.7 | −40.4% |

From the data derived from tests performed at 20° C., it is apparent that deformation of aluminum and magnesium alloys in hydrogen gas generally occurred under conditions of increased ductility of the alloys. All of the samples derived from extruded sheets of aluminum alloys exhibited modest to substantial increases in both percent elongation and percent reduction of area when tested in hydrogen, as compared to tests performed in air. This effect is in sharp contrast to the drastic decreases in ductility exhibited by the comparative steels. Strength parameters of the aluminum and magnesium alloys showed only modest differences between the tests in hydrogen and the tests in air. The strength data do not give rise to substantial concerns of adverse effects related to deformations in hydrogen, including alloy embrittlement.

Magnesium alloy M01 showed a substantial increase in ductility and virtually no change in strength parameters.

Samples A09, A10, A12, and A14 were anomalous in that one ductility parameter increased in hydrogen while the other parameter decreased. None of the anomalous values were from extruded sheet samples, however, and discrepancies may to some extent be attributable to the form of the sample. Therefore, further tests were performed on bar samples at −50° C.

Similar mechanical tests were performed at −50° C. on two groups of drawn bars of alloys A07, A09, A12, and M01. The first group was tested in air at approximately atmospheric pressure (0.1 MPa). The second group was tested in an atmosphere comprising 99.9999 vol. % hydrogen at 10 MPa. The gauge length of each sample was 30 mm. The testing comprised loading a sample into a tensile testing apparatus and establishing the desired atmosphere, pressure, and temperature. Tensile stress was applied to each sample, increasing at a rate of 0.1 mm/min, resulting in a calculated strain rate of $5.5\times10^{-5}$ $s^{-1}$. Tensile stress was increased until the samples failed, and strength and ductility parameters were determined. Strength data for the two groups can be found in TABLE 6. Ductility data for the two groups can be found in TABLE 7.

TABLE 6

Strength parameters for samples tested at −50° C. Tests in 99.9999 vol. % $H_2$ were performed at 10 MPa. Tests in air were performed at 0.1 MPa.

| | | Yield Strength (MPa) | | | Ultimate Tensile Strength (MPa) | | |
|---|---|---|---|---|---|---|---|
| Sample | Form | Air | $H_2$ | % Change $H_2$ vs. Air | Air | $H_2$ | % Change $H_2$ vs. Air |
| A07 | bar | 370 | 377 | 1.9% | 390 | 400 | 2.6% |
| A09 | bar | 358 | 373 | 4.2% | 381 | 397 | 4.2% |
| A12 | bar | 565 | 574 | 1.6% | 622 | 638 | 2.6% |
| M01 | bar | 252 | 249 | −1.2% | 302 | 301 | −0.3% |
| Comparative: AISI 304 (DIN 1.4301) | | 312 | 322 | 3.2% | 949 | 537 | −43.4% |
| Comparative: AISI 316L (DIN 1.4404) | | 278 | 280 | 0.7% | 850 | 699 | −17.8% |

TABLE 7

Ductility parameters for samples tested at −50° C. Tests in 99.9999 vol. % $H_2$ were performed at 10 MPa. Tests in air were performed at 0.1 MPa.

| | | Elongation (%) | | | Reduction in Area (%) | | |
|---|---|---|---|---|---|---|---|
| Sample | Form | Air | $H_2$ | % Change $H_2$ vs. Air | Air | $H_2$ | % Change $H_2$ vs. Air |
| A07 | bar | 10.1 | 12.9 | 27.7% | 44 | 47.3 | 7.5% |
| A09 | bar | 8.1 | 10.6 | 30.9% | 38 | 38.9 | 2.4% |
| A12 | bar | 8.2 | 9.9 | 20.7% | 23 | 20.7 | −10.0% |
| M01 | bar | 8.1 | 15.2 | 87.7% | 13 | 22 | 69.2% |
| Comparative: AISI 304 (DIN 1.4301) | | 54.6 | 17.6 | −67.8% | 73.8 | 24.7 | −66.5% |
| Comparative: AISI 316L (DIN 1.4404) | | 54.3 | 28.9 | −46.8% | 78.2 | 26.1 | −66.6% |

All of the drawn bars of aluminum and magnesium alloys exhibited substantial increases in percent elongation when tested in hydrogen gas at −50° C. Except for alloy A12, all aluminum and magnesium alloy samples also showed marked increase in percent reduction of area. The increase in ductility of magnesium alloy M01 was especially noteworthy. Both steels, presented as comparative examples, showed substantial loss of ductility. The changes in strength in all aluminum and magnesium alloys were relatively small. These results are consistent with a general increase in ductility of aluminum and magnesium alloys deformed in hydrogen gas at −50° C. over the ductility of the same alloys deformed in air.

The data at both 20° C. and −50° C. are consistent with a real increase in ductility of aluminum and magnesium alloys during deformation in hydrogen, as compared to a similar deformation in air. It will be obvious to the person of ordinary skill in the art that deformations in partial hydrogen atmospheres having a balance of inert gas may exhibit less pronounced increases in ductility than do deformations in 99.9999 vol. % hydrogen. Even so, observable increases in ductility may be observable in hydrogen/inert atmospheres comprising as low as 50 vol. % hydrogen when compared to the same deformation performed in air.

The increased ductility of aluminum and magnesium alloys deformed according to embodiments of the invention relates to a consistent and reproducible phenomenon. Therefore, methods for working such alloys in hydrogen would allow a machine operator to take advantage of the increased ductility in a manner not presently known in the art. Increased ductility of aluminum and magnesium alloys can result benefits including greater options for working, enhanced ability to form complex geometries, and lowered costs.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. For example, "substantially conforming to a standard alloy specification." In the present context, the term "substantially" is utilized herein also to represent the degree by which a quantitative representation may vary from a stated reference without resulting in a change in the basic function of the subject matter at issue. As such, it is utilized to represent the inherent degree of uncertainty that may be attributed to any quantitative comparison, value, measurement, or other representation, referring to an arrangement of elements or features that, while in theory would be expected to exhibit exact correspondence or behavior, may in practice embody something slightly less than exact.

Though the invention has been described in detail and by reference to specific embodiments of the invention, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method for increasing ductility of a workpiece during deformation, the method comprising:

providing a workpiece comprising an alloy, the alloy defining an initial ductility and comprising at least 75 weight percent of a metal selected from the group consisting of aluminum and magnesium;

placing the workpiece into a process chamber;

establishing a chamber atmosphere comprising:

at least 50 vol. % hydrogen;

less than 2000 ppm by volume oxygen;

substantially no water vapor; and balance inert gas;

plastically deforming the workpiece; and removing the workpiece from the process chamber, such that at least during a time when the tensile stress is applied to the workpiece, the alloy defines a processing ductility that is greater than the initial ductility.

2. The method of claim 1, wherein the plastically deforming the workpiece further comprises applying a tensile stress to the workpiece, deforming the workpiece to a desired shape, and removing the tensile stress.

3. The method of claim 1, further comprising setting a chamber temperature of between −70° C. and +50° C.

4. The method of claim 3, further comprising pressurizing the process chamber to a pressure of between 0.1 MPa and 30 MPa.

5. The method of claim 4, wherein the chamber atmosphere comprises at least 90 vol. % hydrogen.

6. The method of claim 5, wherein the chamber atmosphere comprises at least 99 vol. % hydrogen.

7. The method of claim 6, wherein the chamber atmosphere comprises at least 99.99 vol. % hydrogen.

8. A method for increasing ductility of aluminum alloy extruded sheet during deformation, the method comprising:

providing an extruded sheet comprising an alloy, the alloy defining an initial ductility and comprising less than 0.2 weight percent titanium and at least 75 weight percent aluminum;

placing the extruded sheet into a process chamber;

establishing a chamber atmosphere comprising:

at least 50 vol. % hydrogen;

less than 2000 ppm by volume oxygen;

substantially no water vapor; and balance inert gas;

plastically deforming the extruded sheet; and removing the extruded sheet from the process chamber, such that at least during a time when the tensile stress is applied to the extruded sheet, the alloy defines a processing ductility that is greater than the initial ductility.

9. The method of claim 8, wherein the plastically deforming the workpiece further comprises applying a tensile stress to the workpiece, deforming the workpiece to a desired shape, and removing the tensile stress.

10. The method of claim 8, further comprising setting a chamber temperature of between −70° C. and +50° C.

11. The method of claim 10, further comprising pressurizing the process chamber to a pressure of between 0.1 MPa and 30 MPa.

12. The method of claim 11, wherein the alloy comprises:

up to 1.3 weight percent silicon;

up to 1.0 weight percent iron;

up to 5.0 weight percent copper;

up to 1.0 weight percent manganese;

up to 0.40 weight percent chromium;

up to 0.25 weight percent zinc;

up to 0.15 weight percent titanium;

0.3 to 3.0 weight percent magnesium; and balance aluminum and incidental impurities.

13. The method of claim 11, wherein the alloy comprises:

11.0 to 13.5 weight percent silicon;

up to 1.0 weight percent iron;

0.5 to 1.3 weight percent copper;

up to 0.1 weight percent chromium;

0.5 to 1.3 weight percent nickel;

up to 0.25 weight percent zinc;

0.8 to 1.3 weight percent magnesium; and balance aluminum and incidental impurities.

14. The method of claim 11, wherein the extruded sheet comprises an automobile component.

15. The method of claim 14, wherein the component comprises a body panel.

16. A method for increasing ductility of a workpiece during deformation, the method comprising:

providing a workpiece comprising an alloy, the alloy defining an initial ductility and comprising at least 75 weight percent magnesium;

placing the workpiece into a process chamber;

establishing a chamber atmosphere comprising:

at least 50 vol. % hydrogen;

less than 2000 ppm by volume oxygen;

substantially no water vapor; and balance inert gas;

plastically deforming the workpiece; and removing the workpiece from the process chamber, such that at least during a time when the tensile stress is applied to the workpiece, the alloy defines a processing ductility that is greater than the initial ductility.

17. The method of claim 16, wherein the plastically deforming the workpiece further comprises applying a tensile stress to the workpiece, deforming the workpiece to a desired shape, and removing the tensile stress.

18. The method of claim 16, further comprising setting a chamber temperature of between −70° C. and +50° C.

19. The method of claim 18, further comprising pressurizing the process chamber to a pressure of between 0.1 MPa and 30 MPa.

20. The method of claim 19, wherein the alloy comprises:

2.5 to 3.5 weight percent aluminum;

0.6 to 1.4 weight percent zinc;

0.2 to 0.5 weight percent manganese;

up to 0.1 weight percent silicon;

up to 0.05 weight percent copper;

up to 0.005 weight percent iron;

up to 0.005 weight percent nickel; and balance magnesium and incidental impurities.

21. The method of claim 20, wherein the workpiece comprises a drawn bar.

22. The method of claim 19, wherein the workpiece comprises a component for an automobile.

23. The method of claim 22, wherein component comprises a body panel.

* * * * *